US005263415A

United States Patent [19]

Pollich

[11] Patent Number: 5,263,415

[45] Date of Patent: Nov. 23, 1993

[54] SHEET GUIDE IN THE DELIVERY SECTION OF A SHEET-FED PRINTING PRESS

[75] Inventor: Gerhard Pollich, Heidelberg, Fed. Rep. of Germany

[73] Assignee: Heidelberger Druckmaschinen AG, Heidelberg, Fed. Rep. of Germany

[21] Appl. No.: 987,025

[22] Filed: Dec. 7, 1992

[30] Foreign Application Priority Data

Dec. 6, 1991 [DE] Fed. Rep. of Germany ..... 4140253

[51] Int. Cl.[5] ..... B41F 13/24; B65H 29/68

[52] U.S. Cl. ..... 101/232; 101/240; 101/409; 271/183; 271/204

[58] Field of Search ..... 101/240, 142, 144, 145, 101/182, 184, 217, 409, 232; 271/276, 194, 195, 196, 197, 204, 183

[56] References Cited

U.S. PATENT DOCUMENTS

| | | | |
|---|---|---|---|
| 2,474,997 | 7/1949 | Wormser | 271/183 |
| 3,096,088 | 7/1963 | Young | 101/409 |
| 3,451,670 | 6/1969 | Staines | 271/183 |
| 3,659,839 | 5/1972 | Baucke | 271/183 |
| 3,986,455 | 10/1976 | Jeschke et al. | 101/409 |
| 4,225,129 | 9/1980 | Zimmermann et al. | 271/204 |
| 4,273,324 | 6/1981 | Philipp | 271/283 |
| 4,479,645 | 10/1984 | Pollich | 271/183 |
| 4,776,577 | 10/1988 | Marschke et al. | 271/183 |
| 5,060,929 | 10/1991 | Kohlmann | 271/183 |
| 5,088,404 | 2/1992 | MacConnell et al. | 101/232 |

FOREIGN PATENT DOCUMENTS

| | | |
|---|---|---|
| 3113750 | 10/1982 | Fed. Rep. of Germany . |
| 3411029 | 10/1987 | Fed. Rep. of Germany . |

*Primary Examiner*—Eugene H. Eickholt

*Attorney, Agent, or Firm*—Herbert L. Lerner; Laurence A. Greenberg

[57] ABSTRACT

In a delivery section of a sheet-fed printing press convertible between single-sided sheet printing and first-form and perfector printing, a sheet guide is provided formed with a sheet guide surface alterable between conditions wherein the surface is formed with throughholes and the surface is continuous and smooth, and a device for altering the sheet guide surface so that it is formed with throughholes when converting the press from first-form and perfector printing to single-sided sheet printing, and for altering the sheet guide surface so that it is continuous and smooth when converting the press from single-sided sheet printing to first-form and perfector printing.

12 Claims, 4 Drawing Sheets

SHEET GUIDE IN THE DELIVERY SECTION OF A SHEET-FED PRINTING PRESS

The invention relates to a sheet guide in the delivery section of a sheet-fed printing press.

German Published Non-Examined Patent Application (DE-OS) 31 13 750 discloses a sheet guide formed of continuous, smooth sheet metal extending between the last printing unit of a sheet-fed printing press and sheet guide-yoke blowers arranged in front of brake rollers. From this German publication, a coated guide cloth has further become known which, in order to maintain a continuous, smooth guiding surface between the brake rollers and the sheet guide-yoke blowers, is automatically moved along with the format-related adjustment movements of the brake rollers. One end of the guide cloth is articulatingly linked to the housing of the brake rollers, and the other end of the guide cloth which faces away from the brake rollers is guided around a deflection rod and, underneath the sheet guide surface, the guide cloth is loaded with a weight to keep it taut.

The continuous, smooth sheet guide surface permits an air cushion to be formed between the sheet guide surface and a paper sheet which is pulled over it. This has proved to be advantageous in first form and perfector printing, because smudging of a printed side of the sheet facing the sheet guide surface can thereby be avoided. In first form or single sided printing, however, wherein only the sheet side facing away from the sheet guide surface is printed, and wherein there is no danger of smudging on the unprinted sheet side facing the sheet guide surface, the negative attributes or disadvantages of a continuous, solid sheet guide surface predominate. The air cushion can cause fluttering of the paper sheets and, at high operating speeds, excessive noise and unstable sheet guidance may result therefrom.

Moreover, it has become known, heretofore, to form the sheet guide surfaces in the delivery of sheetmetal or metal plate with through-bores or perforations provided therein through which the cushion of accumulated air between the sheet guide surface and the paper sheet pulled thereover can leak or escape. Such a sheet guide plate affords a reliable and flutter-free sheet guidance during first form or single-sided printing, the guidance being improvable by applying additional suction. In the process of both first form and perfector printing, however, due to the reliable sheet guidance on the sheet guide plate, smudging occurs on the printed side of the paper sheet facing the sheet guide surface.

Such a sheet guide surface has become known heretofore, for example, from German Patent 34 11 029. In this regard, an attempt is made to eliminate smudging due to the use of this sheet guide surface by reversing the process of sucking air away from the paper sheet into blowing air towards the paper sheet during first form and perfector printing. In order to achieve the desired effect, a costly system for precisely regulating a reversible suction air and blowing air supply is required.

It is accordingly an object of the invention to provide a sheet guide in the delivery of a sheet-fed printing press which, by relatively simple means and in a relatively simple manner, combines the advantages of a continuous, smooth sheet guide surface for use in first-form and perfector printing and the advantages of a sheet guide surface formed with openings for use in printing only on a single side of a sheet.

With the foregoing and other objects in view, there is provided, in accordance with the invention, in a delivery section of a sheet-fed printing press convertible between single-sided sheet printing and first-form and perfector printing, a sheet guide comprising means formed with a sheet guide surface alterable between conditions wherein the surface is formed with throughholes and the surface is continuous and smooth, and means for altering the sheet guide surface so that it is formed with throughholes when converting the press from first-form and perfector printing to single-sided sheet printing, and for altering the sheet guide surface so that it is continuous and smooth when converting the press from single-sided sheet printing to first-form and perfector printing.

With a sheet guide according to the invention, the desired advantage of a reliable and stable sheet guidance on a continuous, smooth sheet guide surface for single-sided sheet printing and the desired smudge-free sheet guidance on a sheet guide surface formed with openings therein for first-form and perfector printing have been achieved. By altering the sheet-guiding surface itself when converting from single-sided sheet printing to first-form and perfector printing and the reverse, i.e., from first-form and perfector printing to single-sided sheet printing, the advantages striven for in both types of printing can be achieved by relatively simple means and without a costly regulating system.

In accordance with another feature of the invention, the sheet guide surface is on at least one sheet guide plate formed with throughholes for single-sided sheet printing, the altering means including means for covering the throughholes for first-form and perfector printing. It is thereby possible, in the case of a fixedly attached sheet guide surface, to alter the sheet guide surface as desired for another type of printing and to change it back again into the original condition thereof.

In accordance with a further feature of the invention, the sheet guide surface is on a single perforated sheet guide plate for single-sided sheet printing. This permits an especially simple and low-cost construction with commercially available perforated plate with relatively little time required for installation.

In accordance with an added feature of the invention, the covering means constitute a one-piece cover material having a continuous surface covering the throughholes for first-form and perfector printing. Altering of the sheet-guide surfaces in an especially simple way is thus afforded, because the cover for the openings is formed of one piece, and no additional provisions are required to ensure a smooth, impact-free sheet-guiding surface for first-form and perfector printing.

In accordance with an additional feature of the invention, the one-piece cover material is a foil. An especially simple alteration of the sheet guide surface is thereby afforded, in that the throughholes in the sheet guide surface are uncovered and covered again by the foil at an almost nonvarying level, with respect to the sheets transported thereover. The light weight and low volume of the foil is user-friendly and, regarding the uncovered sheet guide surface, no storage problem exists.

In accordance with yet another feature of the invention, the altering means comprise a first stationary winding device rotatably mounted below the sheet guide surface formed with throughholes and transversely to the sheet transport direction for receiving thereon a band of foil, a second stationary winding device rotatably mounted below the sheet guide surface formed with throughholes and transversely to the sheet transport direction, retracting means via which the second winding device is operatively connected with the foil, the winding devices being operatively connected with one another with mutually opposing forces acting in opposite directions of one another, and having an adjustable resultant force.

In accordance with yet a further feature of the invention, there are provided drive means operatively connected with one of the winding devices, force-storage means operatively connected with the other of the winding devices, one end of the band of foil being secured to the one winding device, the retracting means comprising at least one elongated element, and one end of the elongated element being secured to the other winding device, the other end of the elongated retractive element being linked with the other end of the foil.

In accordance with yet an added feature of the invention, the first winding device includes a winding roll for receiving the band of foil thereon, a spiral spring operatively connected with the winding roll and braced against a stationary bearing to which one end of the band of foil is fastened; the retracting means comprising two strand-like elements having one end, respectively, linked to the other end of the band of foil, at lateral marginal regions of the band of foil and uniformly spaced with respect to a center line of the band of foil; the second winding device includes two further winding rolls of like diameter mounted so as to be concentrically rotatable and being connected so a to be fixed against rotation relative to one another, the two further winding rolls being disposed downstream from the winding roll of the first winding device, in the sheet transport direction, the respective other end of the strand-like retracting elements being fastened to one of the two further winding rolls, the strand-like retracting elements extending parallel to one another between the further winding rolls and the band of foil; and including adjustable drive means operatively connected with the further winding rolls.

In accordance with yet an additional feature of the invention, the foil is a plastic foil.

In accordance with still another feature of the invention, the foil is a metal foil.

In accordance with still a further feature of the invention, the elongated element is a tape.

In accordance with a concomitant feature of the invention, the elongated element is a string.

Other features which are considered as characteristic for the invention are set forth in the appended claims.

Although the invention is illustrated and described herein as embodied in sheet guide in the delivery section of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
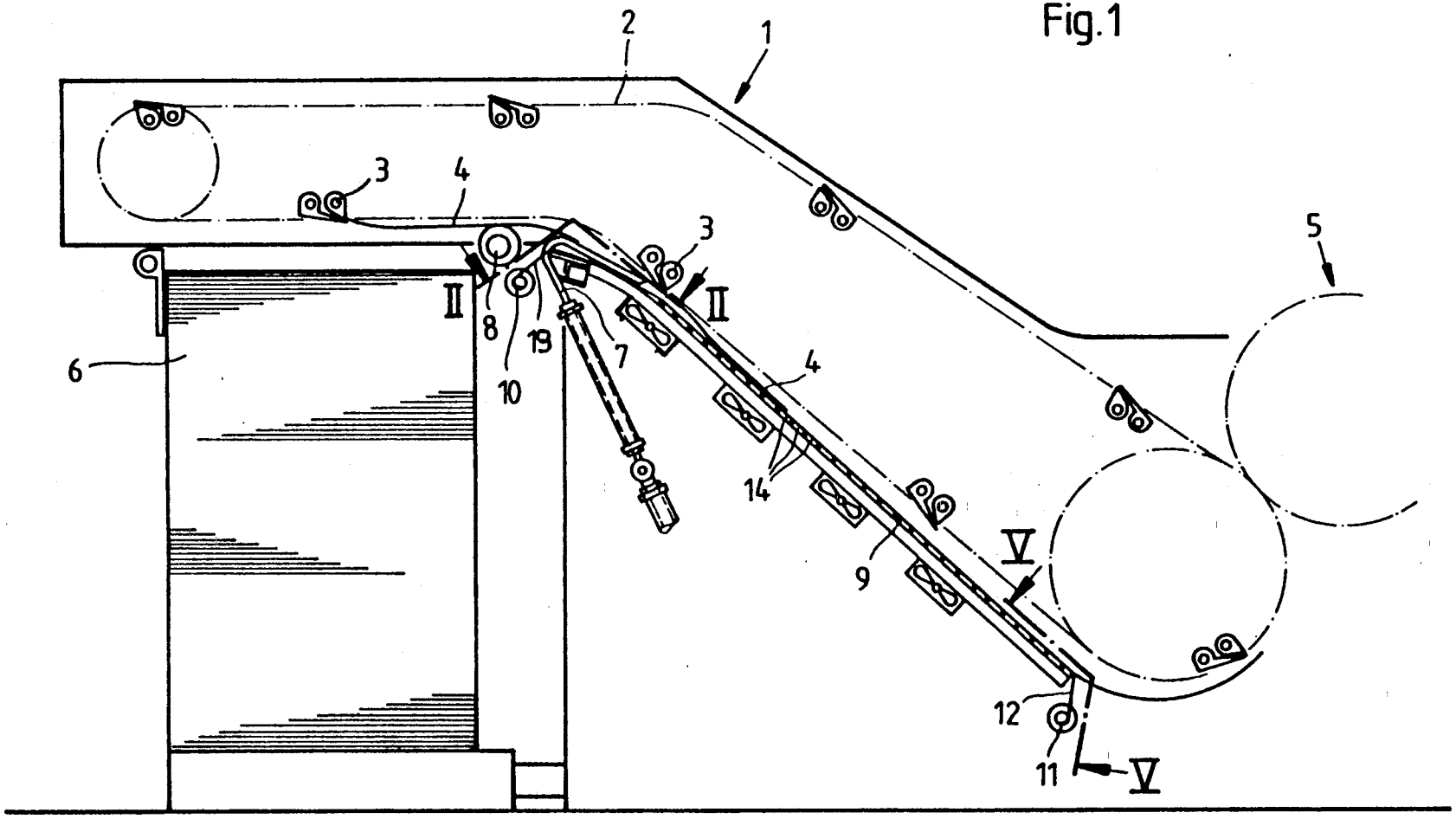
FIG. 1 is a diagrammatic side elevational view of an embodiment of the sheet guide according to the invention having a perforated plate and a retractable foil and being disposed in the delivery of a sheet-fed rotary printing press.

Referring now to the drawings and, first, particularly to FIG. 1 thereof, there is shown therein a delivery 1 of a sheet-fed rotary printing press wherein paper sheets 4 are pulled, by means of gripper bars 3 which are fastened to revolving chains 2, from a last printing unit 5 over a sheet guide surface formed by a conventional, commercially available perforated plate 9 formed with through-holes 14. Brake rollers 8 are arranged behind the perforated plate 9, as viewed in sheet transport direction, and the sheets 4 are reliably brought into working contact therewith by means of sheet guide-yoke blowers 7 disposed directly in front or upstream of the brake rollers 8, as viewed in the sheet transport direction. The paper sheets 4 are braked or decelerated by the brake rollers 8 and deposited on a pile located behind or downstream of the brake rollers 8, as viewed in sheet transport direction. The perforated plate 9 is fastened in side parts or frames 15 and 16 of the delivery.

Below the sheet guide surface, a foil winding roll 11 is disposed in front or upstream of the perforated plate 9, and a tape winding roll 10 behind or downstream of the perforated plate 9, both as viewed in sheet transport direction.

Figure 2:
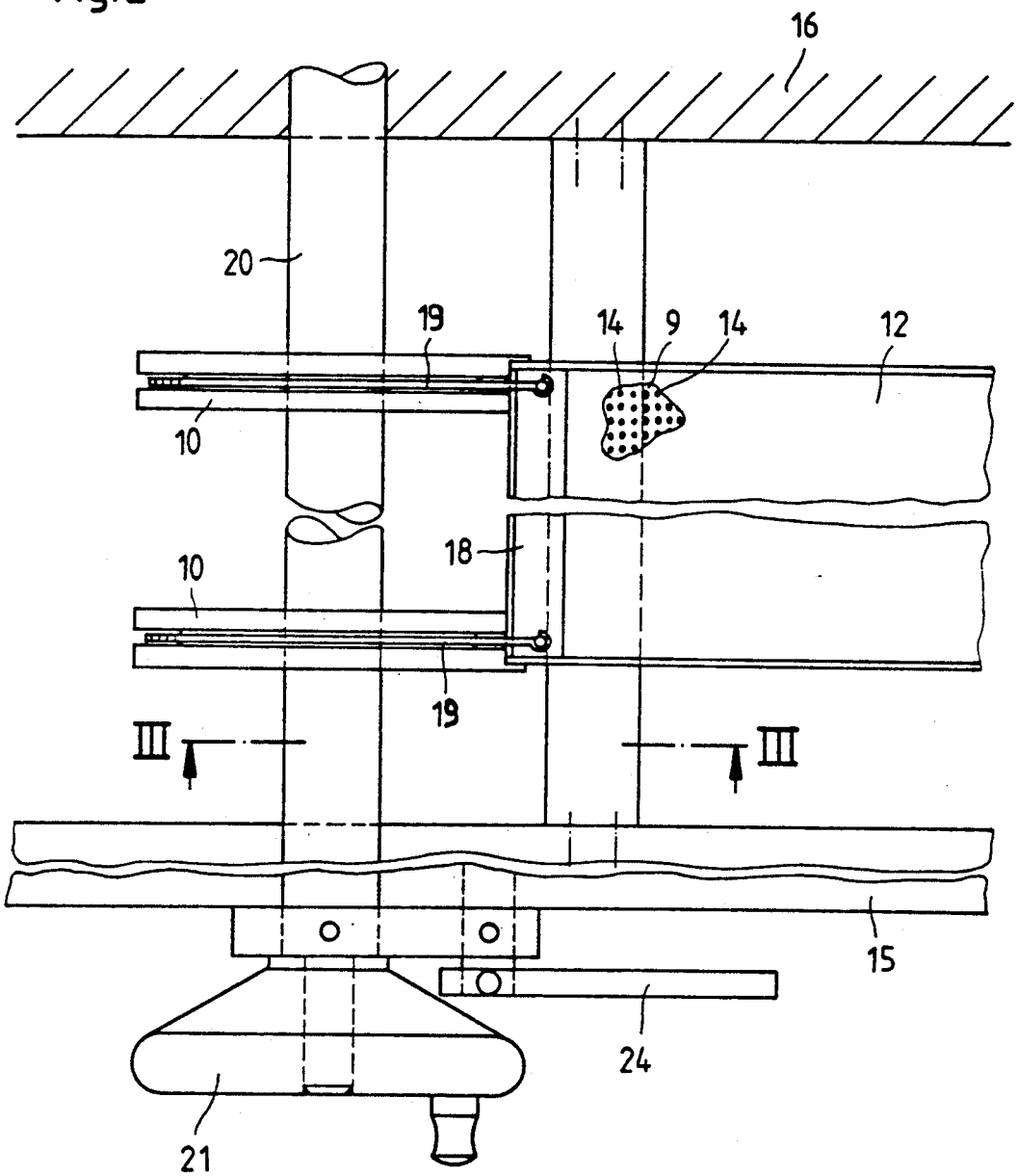
FIG. 2 is a greatly enlarged cross-sectional view of FIG. 1, taken along the line II—II in the direction of the arrows and showing the sheet guide surface for single-sided printing.
Figure 3:
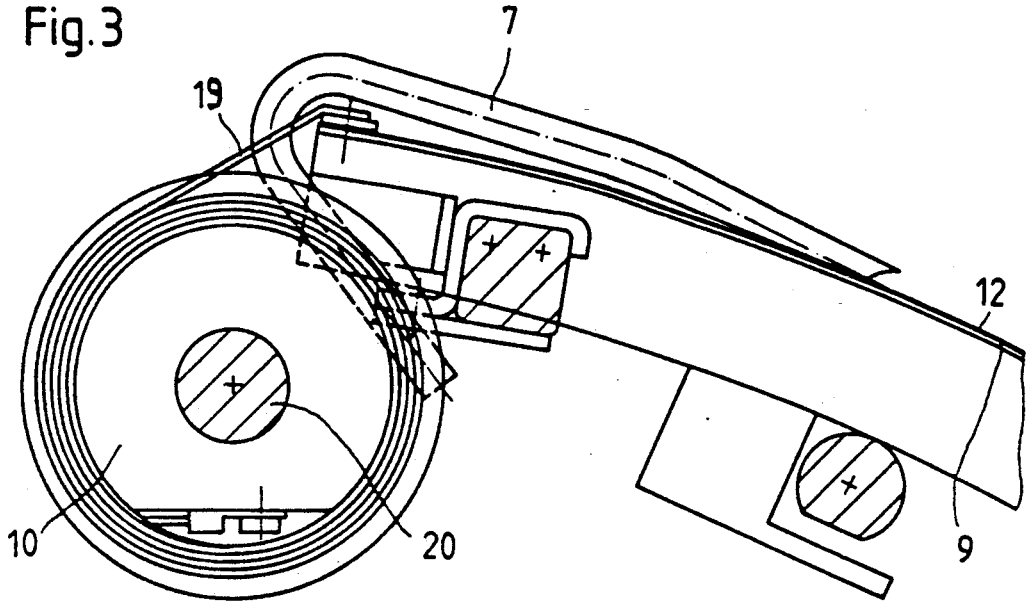
FIG. 3 is a sectional view of FIG. 2 taken along the line III—III in the direction of the arrows and showing the sheet guide surface with a winding roll.
Figure 4:
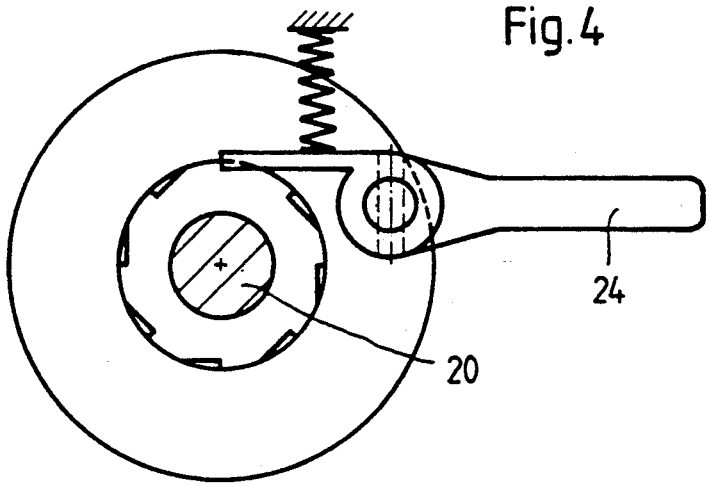
FIG. 4 is a fragmentary side elevational view of FIG. 2 showing a hand crank of a winding device for the winding roll and including a diagrammatically illustrated locking device.
Figure 6:
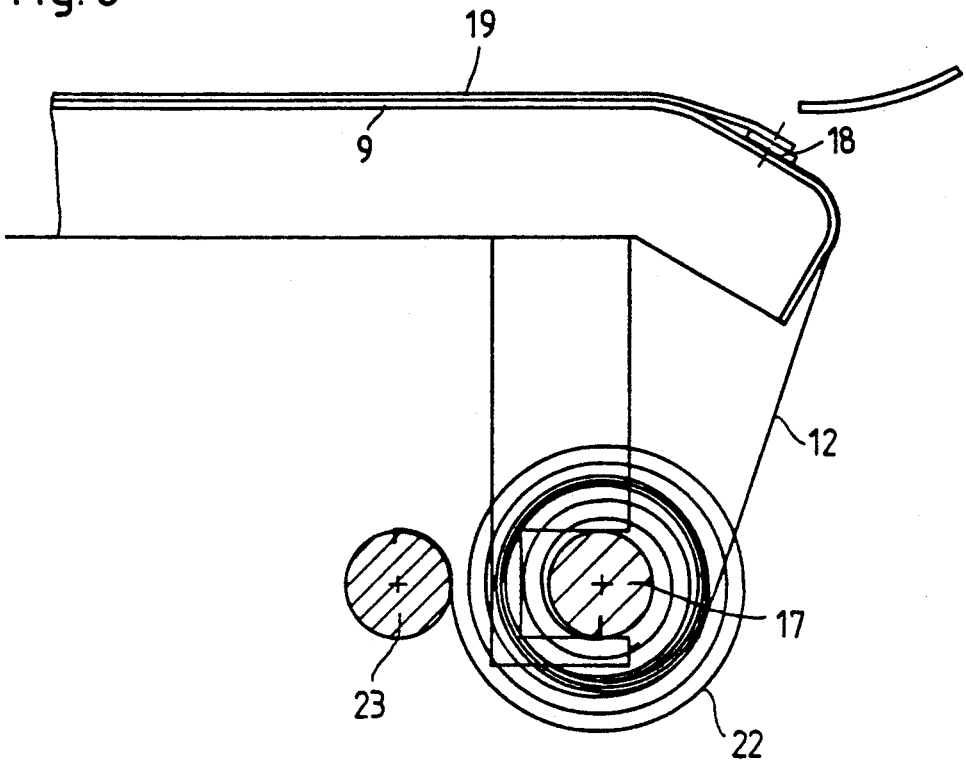
FIG. 6 is a sectional view of FIG. 5 taken along the line VI—VI in the direction of the arrows.
Figure 5:
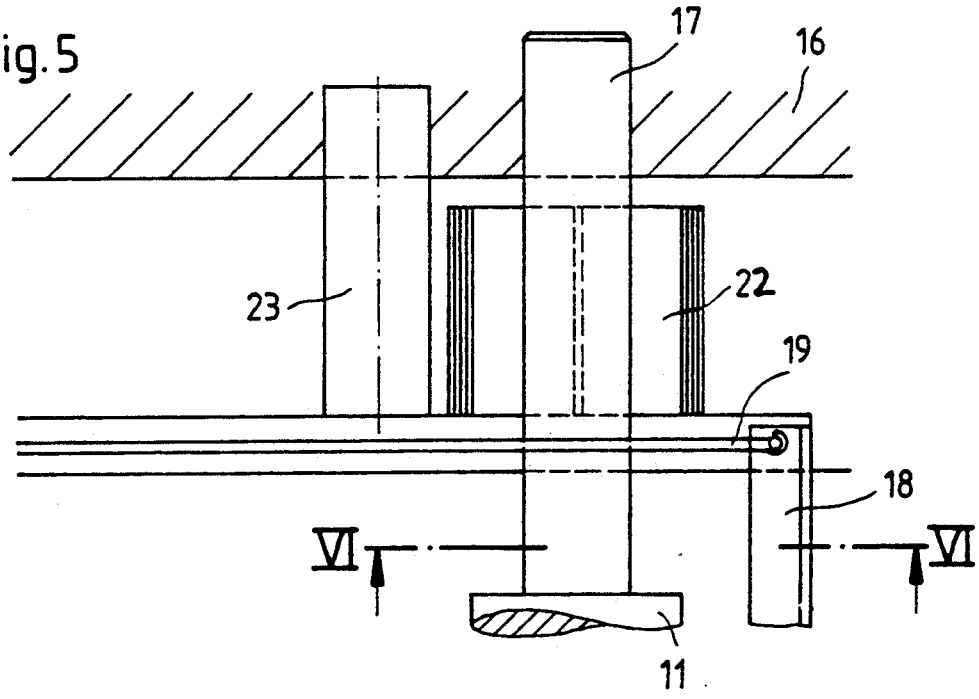
FIG. 5 is a fragmentary sectional view of FIG. 1 taken along a line V—V in the direction of the arrows and showing the inventive sheet guide with a foil pulled thereover as used in a single-sided printing setting.

As shown in FIGS. 5 and 6, the foil winding roll 11 has an axis extending transversely to the sheet transport direction and is rotatably mounted by bearing pins or trunnions 17 in the side parts 15 and 16, of which only the side part 16 is shown in FIG. 5. Band or strip-shaped foil 12 formed of metal or synthetic material is aligned symmetrically with the center line of the perforated plate 9 and is fastened at one end thereof to the foil winding roll 11. The width of the foil is of a smaller dimension than the distance between the two side parts 15 and 16, but greater than the maximum acceptable width of the paper sheets. At the other end of the foil 12, a securing strip 18 disposed transversely to the sheet transport direction is attached to the foil 12 and extends across the width thereof. A respective retracting or tensioning tape 19 is articulatingly linked to both outer end regions of the securing strip 18 facing towards the side parts 15 and 16. The retracting tapes 19 are guided parallel to one another over outer marginal regions or rims of the perforated plate 9 in the sheet transport direction and at an equal lateral distance from the center line of the perforated plate 9. The retracting tapes 19 are attached to the tape winding rolls 10 at the ends thereof facing away from the securing strip 18, as shown in FIGS. 1, 2 and 3. The tape winding rolls 10 are of mutually equal diameter and are rotatably mounted on a common concentric shaft 20 journalled in the side frames 15 and 16. A handwheel 21 is fastened to an extension of the shaft 20 passing through the side part 15.

By means of the handwheel 21, the tapes 19 can be wound onto the tape winding rolls 10, so that the tapes 19 forcibly pull the foil 12 onto and over the perforated plate in the sheet transport direction. The foil 1 is kept under tension by means of a spiral spring 22 which is braced, at one end thereof, against the trunnion 17 and, at the other end thereof, against a spring bearing pin 23, thereby acting in a direction counter to the pulling direction of the tapes 13. By means of a locking lever 24, the shaft 20 and, accordingly, the foil 12, in cooperation with the resetting spiral spring 22, can be secured in sheet transport direction in a desired position wherein the throughholes 14 of the perforated plate 9 are covered.

For first-form and perfector printing, the foil 12 is pulled over the perforated plate 9 so that it completely covers the throughholes 14, and the securing strip 18 is located below the sheet guide-yoke blowers 7, as shown in FIG. 3. In this position, the shaft 20 is locked. The transported paper sheets 4 are thus guided over a continuous, smooth surface, above which an air cushion is formed by the movement of the respective sheet 4, so that the printed side of the sheet 4 facing the foil 12 does not come into contact with the foil 12, and smudging of the printed sides is thereby avoided.

For single-sided printing, the locking lever 24 is released. The resetting force of the spring 22 causes the foil 12 to be wound onto the foil winding roll 11. The securing strip 18 is pulled over the perforated plate 9 in a direction opposite to the transport direction of the paper sheets 4, so that the securing strip 18 unwinds the retracting tapes 19 from the tape winding rolls 10 until the securing strip 18 is pulled under the sheet guide surface. In this position, the shaft 20 is locked again by the locking lever 24. The paper sheets then transported are conveyed directly over the perforated plate 9 and between the tapes 19 without coming into contact with the tapes 19. The cushion of air which thereby forms between the paper sheets 4 and the perforated plate 9 can disappear again through the throughholes 14 in the perforated plate 9. The conveyed paper sheets 4 are thus transported with the end thereof located opposite the gripper 3 silently and securely lying on the perforated plate 9 without fluttering.

It is possible to provide additional suction, in the case of single-sided printing, by means of a suction arrangement disposed below the perforated plate 9.

It is likewise conceivable to use retracting cord or strings instead of the retracting tapes 19. In place of a hand wheel 21, it is obviously also possible to provide a motorized drive, such as an electric motor, for example.

The foregoing is a description corresponding in substance to German Application P 41 40 253.7, dated Dec. 6, 1991, the International priority of which is being claimed for the instant application, and which is hereby made part of this application. Any material discrepancies between the foregoing specification and the aforementioned corresponding German application are to be resolved in favor of the latter.

I claim:

1. In a delivery section of a sheet-fed printing press convertible between single-sided sheet printing and first-form and perfector printing, a sheet guide comprising means formed with a sheet guide surface alterable between conditions wherein said surface is formed with throughholes and said surface is continuous and smooth, and means for altering said sheet guide surface so that it is formed with throughholes when converting the press from first-form and perfector printing to single-sided sheet printing, and for altering said sheet guide surface so that it is continuous and smooth when converting the press from single-sided sheet printing to first-form and perfector printing.

2. Sheet guide according to claim 1, wherein said sheet guide surface is on at least one sheet guide plate formed with throughholes for single-sided sheet printing, said altering means including means for covering said throughholes for first-form and perfector printing.

3. Sheet guide according to claim 2, wherein said sheet guide surface is on a single perforated sheet guide plate for single-sided sheet printing.

4. Sheet guide according to claim 2, wherein said covering means constitute a one-piece cover material having a continuous surface covering said throughholes for first-form and perfector printing.

5. Sheet guide according to claim 4, wherein said one-piece cover material is a foil.

6. Sheet guide according to claim 5, wherein said altering means comprise a first stationary winding device rotatably mounted below said sheet guide surface formed with throughholes and transversely to said sheet transport direction for receiving thereon a band of foil, a second stationary winding device rotatably mounted below the sheet guide surface formed with throughholes and transversely to the sheet transport direction, retracting means via which said second winding device is operatively connected with said foil, said winding devices being operatively connected with one another with mutually opposing forces acting in opposite directions of one another, and having an adjustable resultant force.

7. Sheet guide according to claim 6, including drive means operatively connected with one of said winding devices, force-storage means operatively connected with the other of said winding devices, one end of said band of foil being secured to said one winding device, said retracting means comprising at least one elongated element, and one end of said elongated element being secured to said other winding device, the other end of said elongated retractive element being linked with the other end of said foil.

8. Sheet guide according to claim 6, wherein said first winding device includes a winding roll for receiving the band of foil thereon, a spiral spring operatively connected with said winding roll and braced against a stationary bearing to which one end of the band of foil is fastened; said retracting means comprising two strand-like elements having one end, respectively, linked to the other end of the band of foil, at lateral marginal regions of the band of foil and uniformly spaced with respect to a center line of the band of foil; said second winding device includes two further winding rolls of like diameter mounted so as to be concentrically rotatable and being connected so as to be fixed against rotation relative to one another, said two further winding rolls being disposed downstream from said winding roll of said first winding device, in the sheet transport direction, the respective other end of said strand-like retracting elements being fastened to one of said two further winding rolls, said strand-like retracting elements extending parallel to one another between said further winding rolls and said band of foil; and including adjustable drive means operatively connected with said further winding rolls.

9. Sheet guide according to claim 5, wherein the foil is a plastic foil.

10. Sheet guide according to claim 5, wherein the foil is a metal foil.

11. Sheet guide according to claim 7, wherein said elongated element is a tape.

12. Sheet guide according to claim 7, wherein said elongated element is a string.

* * * * *